United States Patent [19]

Robbins, III

[11] Patent Number: 4,874,106

[45] Date of Patent: Oct. 17, 1989

[54] COLLAPSIBLE CONTAINERS

[76] Inventor: Edward S. Robbins, III, 459 N. Court St., Florence, Ala. 35630

[21] Appl. No.: 241,378

[22] Filed: Sep. 7, 1988

[51] Int. Cl.[4] ..... B65D 6/22

[52] U.S. Cl. ..... 220/4 F; 220/6; 220/67; 220/73; 220/76; 220/307; 229/5.5

[58] Field of Search ..... 220/4 F, 4 R, 6, 67, 220/73, 76, 83, 307; 229/4.5, 5.5

[56] References Cited

U.S. PATENT DOCUMENTS

| | | | |
|---|---|---|---|
| 1,249,099 | 12/1917 | Huye | 229/5.5 X |
| 1,673,769 | 6/1928 | Graham | 220/6 |
| 1,769,019 | 7/1930 | Flagstad | 220/6 |
| 2,130,019 | 9/1938 | Meier | 206/45.34 |
| 2,577,248 | 12/1951 | James | 229/23 R |
| 3,130,850 | 4/1964 | Oakey et al. | 220/6 |
| 3,195,506 | 7/1965 | Beard | 220/6 X |
| 3,490,679 | 1/1970 | Heller et al. | 229/23 R |
| 3,497,127 | 2/1970 | Box | 220/6 X |
| 3,515,302 | 6/1970 | Curran | 220/4 R |
| 3,622,037 | 11/1971 | Gildart | 220/73 |
| 3,658,035 | 4/1972 | Harris | 220/6 X |
| 3,712,530 | 1/1973 | Croley | 229/4.5 |
| 3,741,843 | 6/1973 | Louis | 220/6 |
| 3,796,342 | 3/1974 | Sanders et al. | 220/6 |
| 3,899,117 | 8/1975 | Peyser et al. | 229/5.5 |
| 3,907,193 | 9/1975 | Heller | 229/16 R |
| 3,913,774 | 10/1975 | Vajtay | 220/4 R |
| 3,941,300 | 3/1976 | Troth | 229/5.5 |
| 3,986,659 | 10/1976 | Vajtay | 220/4 R X |
| 4,101,052 | 7/1978 | Dove | 229/23 R |
| 4,117,971 | 10/1978 | Itoh | 220/67 X |
| 4,201,306 | 5/1980 | Dubois et al. | 220/67 X |
| 4,214,669 | 7/1980 | McQuiston | 220/6 |
| 4,256,236 | 3/1981 | Haase | 220/6 |
| 4,346,832 | 8/1982 | Werner | 229/4.5 |
| 4,355,759 | 10/1982 | Amberg | 229/5.5 |
| 4,498,598 | 2/1985 | Bae | 220/6 |
| 4,556,166 | 12/1985 | Penttilä | 229/5.5 X |
| 4,624,380 | 11/1986 | Wernette | 220/6 |
| 4,651,791 | 3/1987 | Evenson | 229/5.5 X |
| 4,673,087 | 6/1987 | Webb | 220/4 F X |

*Primary Examiner*—John Rivell

*Attorney, Agent, or Firm*—Nixon & Vanderhye

[57] ABSTRACT

A collapsible container includes plural side walls joined so as to be movable between a generally flat condition, and an erected condition whereby an interior area of preselected cross-sectional geometry is defined. A bottom wall is removably coupled to a lower region of the side walls when in their erected condition. The bottom wall thus serves, at least in part, to assist in maintaining the side walls in their erected condition. A peripheral seal is provided with the bottom wall so that when it is coupled to the side walls, the bottom and side walls will be sealed to thereby minimize (if not eliminate) leakage therebetween. Preferably, the seal is flexible and is outwardly flared so that when the bottom wall is coupled to the side walls, the seal will engage the latter and be inwardly flexed against its tendency to flare outwardly. This inward flexion of the seal ensures that sealing contact is maintained between the seal and the side walls. The seal may also be provided by an annular bead formed on a peripheral edge of the bottom wall which seats with an annular concavity formed on the side walls and thus effectively seal the bottom and side walls thereat.

37 Claims, 6 Drawing Sheets

COLLAPSIBLE CONTAINERS

FIELD OF THE INVENTION

The present invention relates generally to containers which may be collapsed into a substantially flat configuration (so as to minimize space during storage, transport, etcetera), yet are capable of being erected at the point of use to establish an interior area for receiving and containing materials, articles, and the like.

BACKGROUND OF THE INVENTION AND INFORMATION DISCLOSURE STATEMENT

Collapsible containers, in and of themselves, are not new. Indeed, the art is replete with various proposals to provide a container whose walls may be collapsed to a substantially flat storage condition, yet are capable of being erected to provide an interior volume for accepting a variety of articles. As a non-exhaustive sample of such prior proposals, the reader's attention is directed to the following U.S. Patents:

| U.S. Pat. No. | Patentee | Issue Date |
|---|---|---|
| 3,796,342 | Sanders et al. | Mar. 12, 1974 |
| 4,256,236 | Haase | Mar. 17, 1981 |
| 1,249,099 | Huye | Dec. 4, 1917 |
| 2,577,248 | James | Dec. 4, 1951 |
| 3,490,679 | Heller et al | Jan. 20, 1970 |
| 4,101,052 | Dove | Jul. 18, 1978 |
| 4,498,598 | Bae | Feb. 12, 1985 |
| 4,624,380 | Wernette | Nov. 25, 1986 |
| 4,673,087 | Webb | Jun. 16, 1987 |
| 2,130,019 | Meier | Jun. 16, 1987 |
| 2,130,019 | Meier | Sep. 13, 1938 |
| 3,497,127 | Box | Feb. 24, 1970 |
| 3,658,035 | Harris | Apr. 25, 1972 |
| 1,673,769 | Graham | Jun. 12, 1928 |
| 1,769,019 | Flagstad | Jul. 1, 1930 |
| 3,130,850 | Oakey et al | Apr. 28, 1964 |
| 3,195,506 | Beard | Jul. 20, 1965 |
| 4,214,669 | McQuiston | Jul. 29, 1980 |

As the reader will appreciate from even a cursory review of the above-cited U.S. Patents, one problem with which collapsible containers do not address (to the best of the present applicant's knowledge) is an inability to effectively seal an otherwise removable bottom wall against material leakage. This problem may, for example, be evidenced by the leakage of liquid waste when collapsible containers of the prior art are used as trash receptacles. Or, the problem may be evidenced by leakage of solid materials (particularly finely divided solid particulates) when collapsible containers are used to transport and/or store the same.

Thus, there still exists a need in this art for a container which is capable of being collapsed to a substantially flat configuration (i.e., so as to reduce the space it requires for transport and/or storage during periods of non-use), but yet provides an effective seal against material leakage. It is towards satisfying such a need that the present invention is directed.

SUMMARY OF THE INVENTION

According to the present invention, a collapsible container is provided which includes a plurality of side walls connected one to another so as to define an enclosure open at each of its ends when in its erected state. The side walls are preferably connected to one another via hinges which are integral with (and formed of the same material as) the side walls themselves. These hinge structures therefore allow the side walls to be collapsed into a generally flat configuration during periods of non-use (and thus facilitate their transport and/or storage), while yet permitting a user to form an erected open-ended structure when it is desired to place a container into service.

A removable bottom wall is connectable to a lower region of the side walls by means to be described in greater detail below so as to close the side walls' lower end when in an erected state. The bottom wall thus provides structural rigidity to the side walls and assists in maintaining the same in their erected state. Further structural rigidity may be provided to the erected container by means of an annular ring and/or lid removably coupled to an upper edge region of the side walls.

The resulting erected container may then be placed into service so to retain a variety of fluid and/or solid materials within its interior space, but is capable of being collapsed (as by removal of the bottom wall and then collapsing the side walls into a generally flat configuration) when its service as a container is no longer needed.

One important aspect of this invention is its ability to effectively seal the bottom wall and side walls against material leakage when the container is erected and in use. According to this invention, a resilient seal lip extends upwardly from the bottom wall and continuously about its peripheral edge. The preferred seal lip gradually upwardly tapers from adjacent the bottom wall's peripheral edge towards a terminal edge of the seal, and is outwardly flared relative to the bottom wall's peripheral edge. The gradual upward taper of the seal lip thus provides a smooth transition between the bottom wall and the interior surfaces of the side walls. The outward flare of the seal lip, coupled with its resilient nature, ensures that it is constantly urged into sealing engagement with the side walls' interior surfaces when the bottom wall is removably coupled to the side walls' lower region.

These, as well as other, objects and advantages of the invention will become more clear after careful consideration is given to the detailed description of the following preferred exemplary embodiments thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein.

Figure 9:
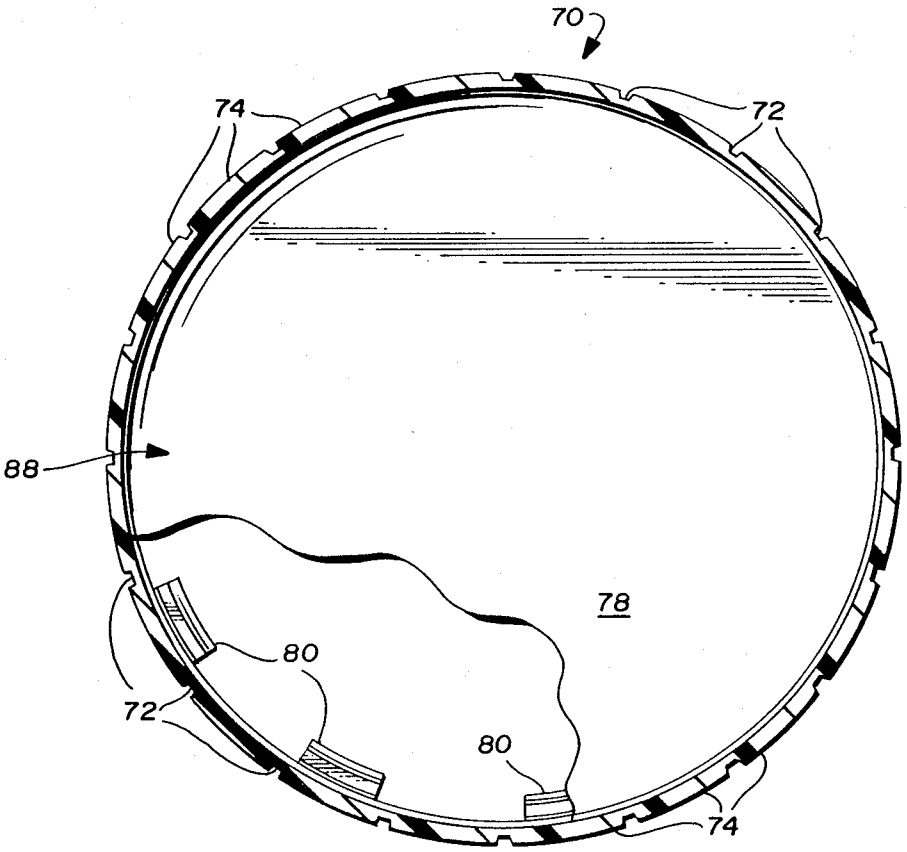
Figure 8:
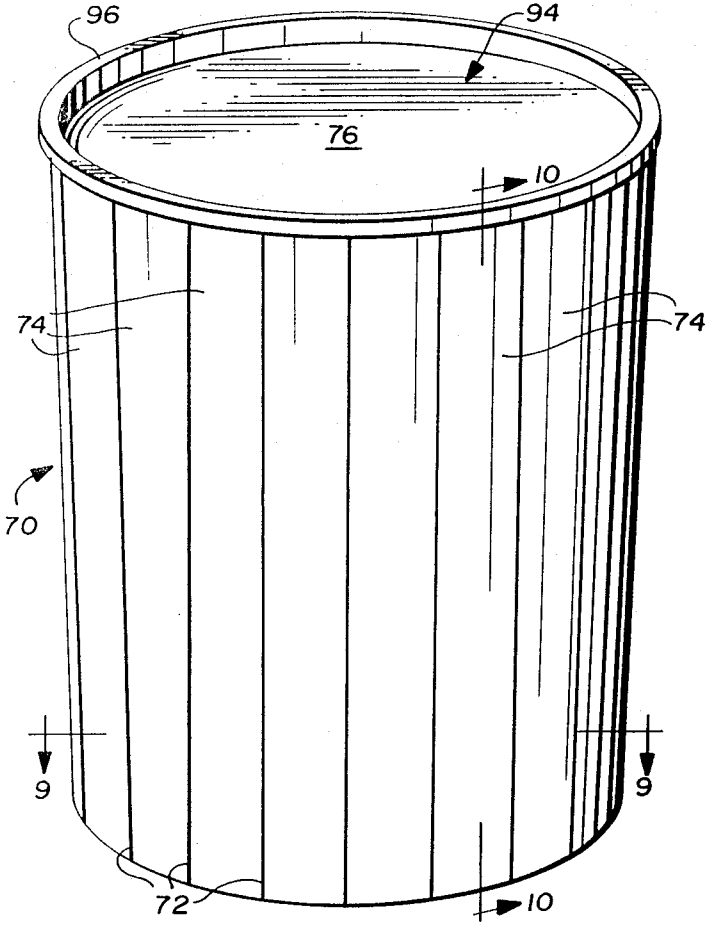
Figure 11:
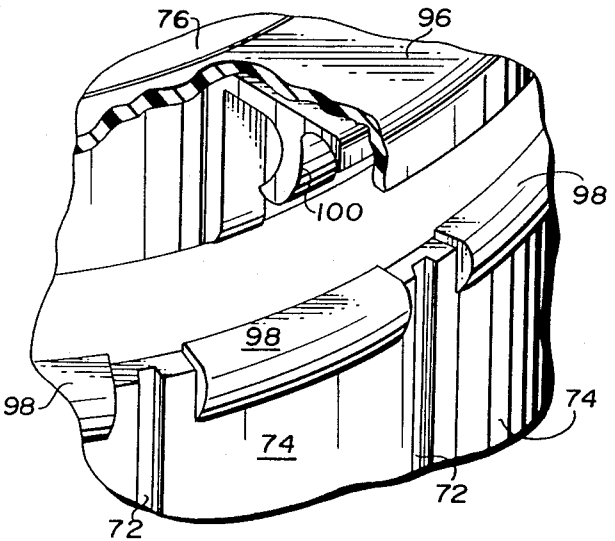
Figure 10:
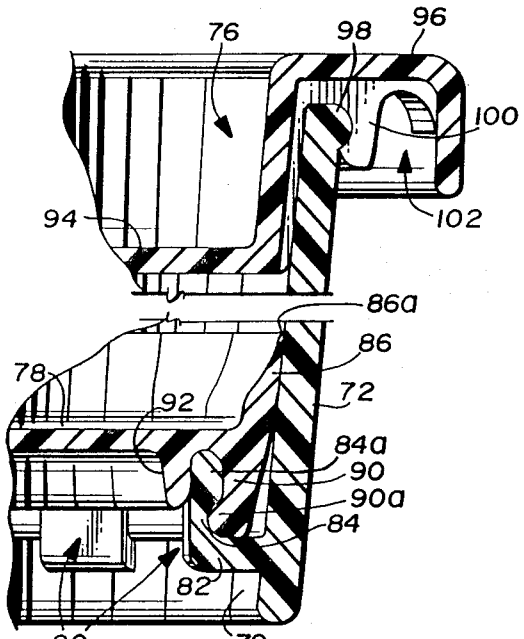
Figure 12:
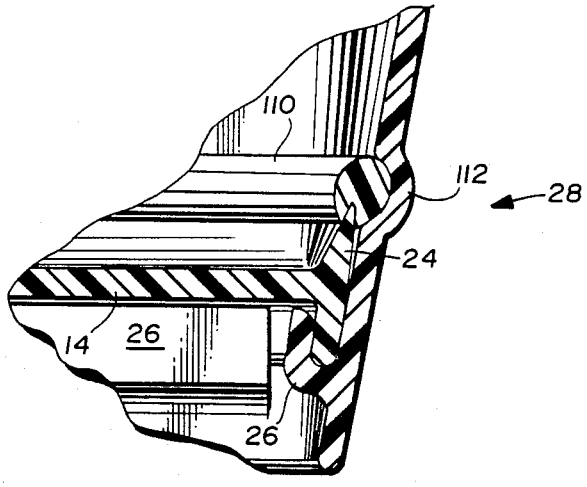
Figure 13:
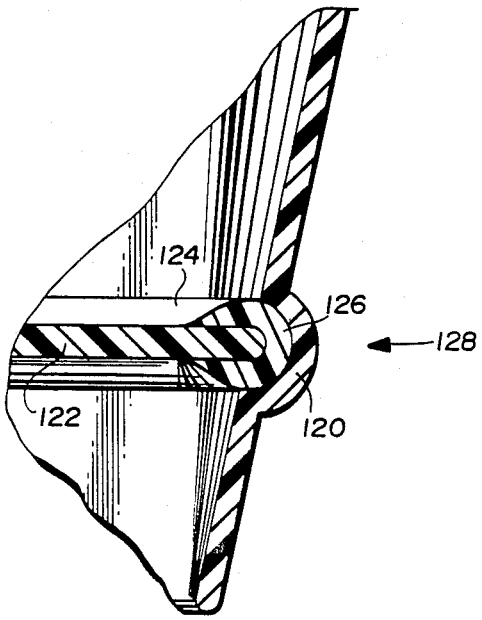

FIGS. 7A–7D collectively show a sequence for erecting a collapsed container according to this invention;

FIG. 8 is a perspective view of another embodiment of a collapsible container according to the present invention;

FIG. 9 is a cross-sectional plan view of the container shown in FIG. 8 and taken along line 9—9 therein;

FIG. 10 is a cross-sectional elevation view of the container shown in FIG. 8 and taken along line 10—10 therein;

FIG. 11 is a partial perspective view of the upper region of the container shown in FIG. 8, but with the lid removed therefrom; and FIGS. 12 and 13 are each partial cross-sectional elevational views showing alternative means which may be employed to effectively seal the bottom and side walls of the containers of this invention.

DETAILED DESCRIPTION OF THE PREFERRED EXEMPLARY EMBODIMENTS

Figure 2:
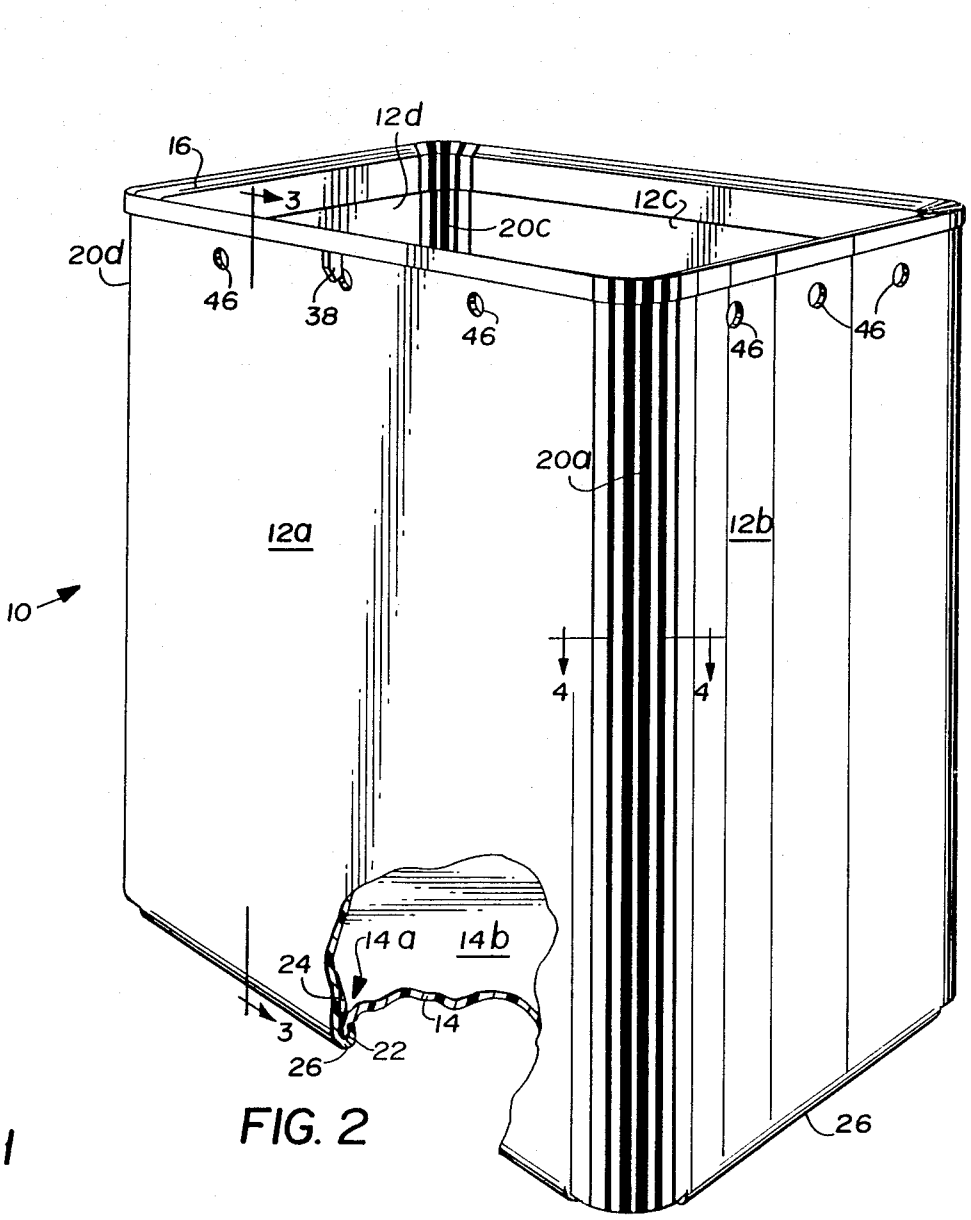
FIG. 2 is an assembled view of the container embodiment depicted in FIG. 1, and partially broken so as to show the bottom wall thereof coupled to the side walls.
Figure 1:
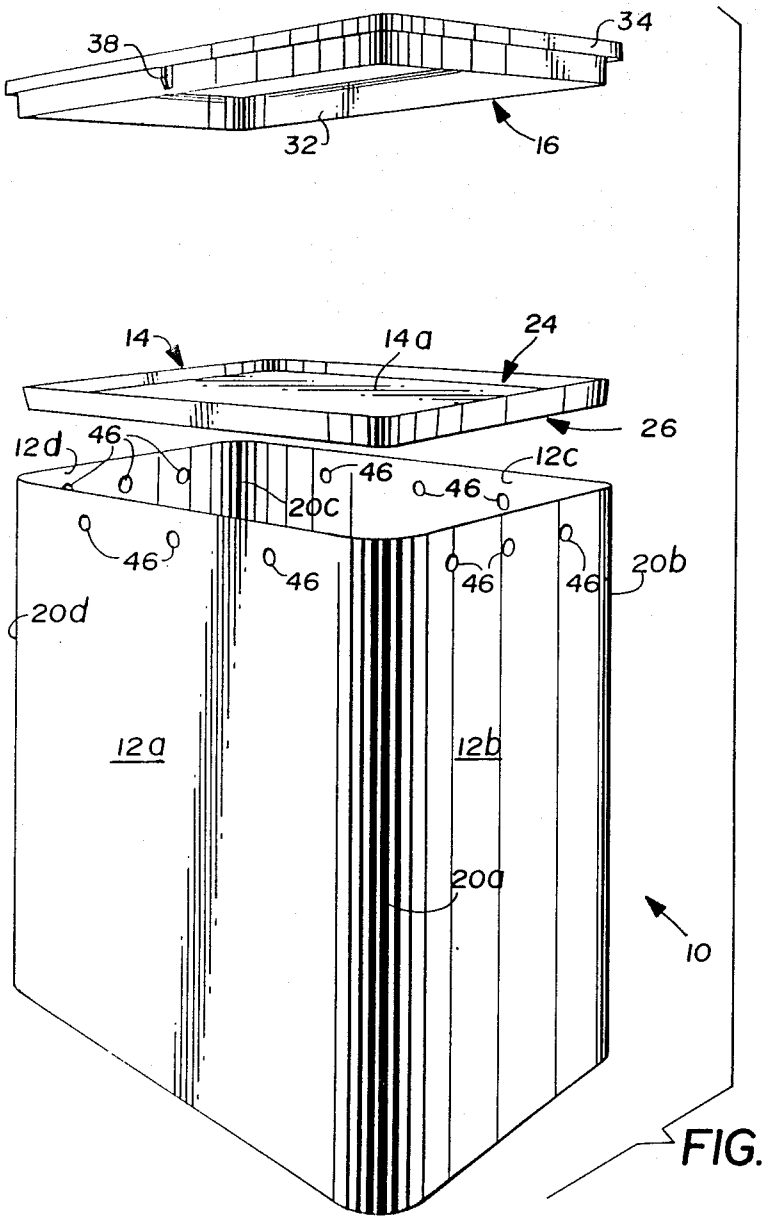
FIG. 1 is a perspective exploded view of one embodiment of the container of this invention.
Figure 4:
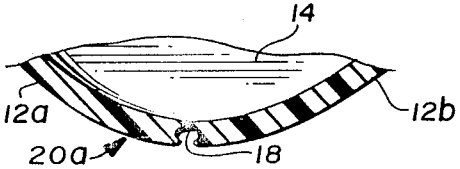
FIG. 4 is a cross-sectional plan view showing a representative corner of the erected container (and particularly the integral hinge associated therewith) as taken along line 4—4 in FIG. 2.

One embodiment of a collapsible container 10 according to the present invention is shown in accompanying FIGS. 1–2. As is seen particularly in FIG. 1, the container 10 is generally comprised of a plurality of side walls **12*a*–12*d*, a removable bottom wall 14, and optionally, an annular retainer 16. Adjacent ones of the side walls 12*a*–12*d* are preferably connected at lateral edges thereof via a hinge 18 (see FIG. 4**).

Hinge 18 is preferably a region of reduced material thickness as compared to the thickness of the side walls **12*a*–12*d*. Thus, the preferred hinge 18 is integral with (and formed of the same material as) the side walls 12*a*–12*d* an thus forms corner regions 20*a*–20*d* when the container 10 is in an erected state. However, separate hinge structures attached to adjacent ones of the side walls 12*a*–12*d* may also be employed without departing from the present invention depending upon the particular material from which container 10 is formed, the intended end use application for container 10**, and the like.

Figure 3:
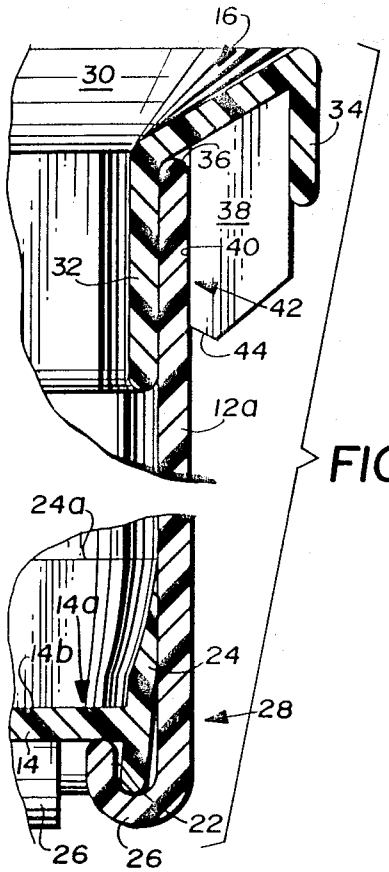
FIG. 3 is a partial cross-sectional view of the container embodiment shown in FIG. 2, and taken along line 3—3 therein.

As is seen more clearly in accompanying FIG. 3, the bottom wall 14 in the embodiment shown in FIGURES 1–2 includes, at its peripheral edge region **14*a*, a downwardly extending engagement flange 22 and an upwardly extending seal lip 24. Portions of the engagement flange 22 are accepted (preferably in press-fit relationship) within a respective receiving flange 26 integrally associated with a bottom region 28 of the side walls 12*a*–12*d*. The receiving flanges 26 are discontinuous with one another about the periphery of the bottom region 28 so as to allow the container 10 to collapse into its substantially flat configuration during periods of nonuse. That is, each end of the receiving flanges 26 extends to closely adjacent a respective one of the corner regions 20*a*–20*d*, but is unconnected at its ends to either the respective corner region 20*a*–20*d* or to an adjacent other one of the receiving flanges 26 (see FIG. 2**).

The resilient seal lip 24 extends upwardly from the peripheral edge region **14*a* of bottom wall 14 oppositely of the engagement flange 22 and is preferably tapered from the peripheral region 14*a* towards its upper terminal edge 24*a*. The taper of the seal lip 24 will ensure a smooth transition between the bounded interior region 14*a* of the bottom wall 14 and the interior surfaces of the side walls 12*a*–12*d*. Unlike the engagement flange 22, the seal lip 24 is continuous about the peripheral edge region 14*a* so as to bound an interior region 14*b* (see FIG. 2) of the bottom wall 14**.

The seal lip 24, moreover, preferably is outwardly flared relative to the bounded interior region **14*b* so that when the bottom wall 14 is coupled to the lower region 28 of the side walls 12*a*–12*d*, it will flex inwardly relative to the bounded region 14*b*. The resilient nature of the seal lip 24 (provided at least in part by its material of fabrication and/or its upwardly directed taper) thus resists such inward flexion and urges the seal lip 24 outwardly (relative to the bounded region 14*a*) into sealing engagement with the interior surfaces of the side walls 12*a*–12*b* continuously about the seal lip's periphery. In such a manner, effective sealing of the bottom wall 14 and side walls 12*a*–12*d* against leakage of material contained within the side walls 12*a*–12*b*** is provided.

The annular retainer 16 is preferably a one-piece structure and includes an upper wall 30, and an interior mounting flange 32 extending downwardly from the upper wall 30. The upper wall 30 is preferably sloped inwardly towards the interior of the container 10 so as to facilitate the placement of material therein. Optionally, the retainer 16 may include a exterior rim 34 extending downwardly from the upper wall 30 a sufficient dimension so as to "hide" the upper edge 36 of side walls **12*a*–12*d*, and thus provide an aesthetically pleasing "finish" to the erected container 10**.

Several clip elements 38 (only one representative clip element 38 being visible in the accompanying drawings) dependently extend from the upper wall 30 of retainer 16. The clip elements each define an interior edge 40 in confronting, but spaced, relationship to the mounting flange 32 so that the upper region 42 of the side walls **12*a*–12*d* is frictionally captured therebetween. The clip elements may also define a lower beveled edge 44 so as to facilitate the guiding of the upper side wall region 42 between the clip element 38 and the mounting flange 32. When positioned in the manner shown in FIG. 2, the retainer 16 will thus serve to rigidify the container 10—that is, will cooperate with the bottom wall 18 so as to prevent the side walls 12*a*–12*d*** from collapsing.

When employed as a trash receptacle, the container 10 may be expected to positionally retain a flexible bag liner. As will be appreciated, an upper portion of the bag liner may also be captured between the clip element 38 and the upper side wall region 42 so as to positionally retain the same. When employed in this end use application, the container side walls **12*a*–12*d* may be provided with vent openings 46 which allow any air trapped between the side walls 12*a*–12*d*** and the bag liner to escape.

Although a presently preferred form of retainer 16 is shown in the accompanying drawing FIGURES, and has been described above, equally successful functions may be realized by using the devices described in commonly-owned U.S. Pat. No. 4,715,572 issued Dec. 29, 1987, and allowed U.S. application Ser. No. 07,095,949 filed Sept. 14, 1987 (the disclosure of each being expressly incorporated hereinto by reference).

Figure 5:
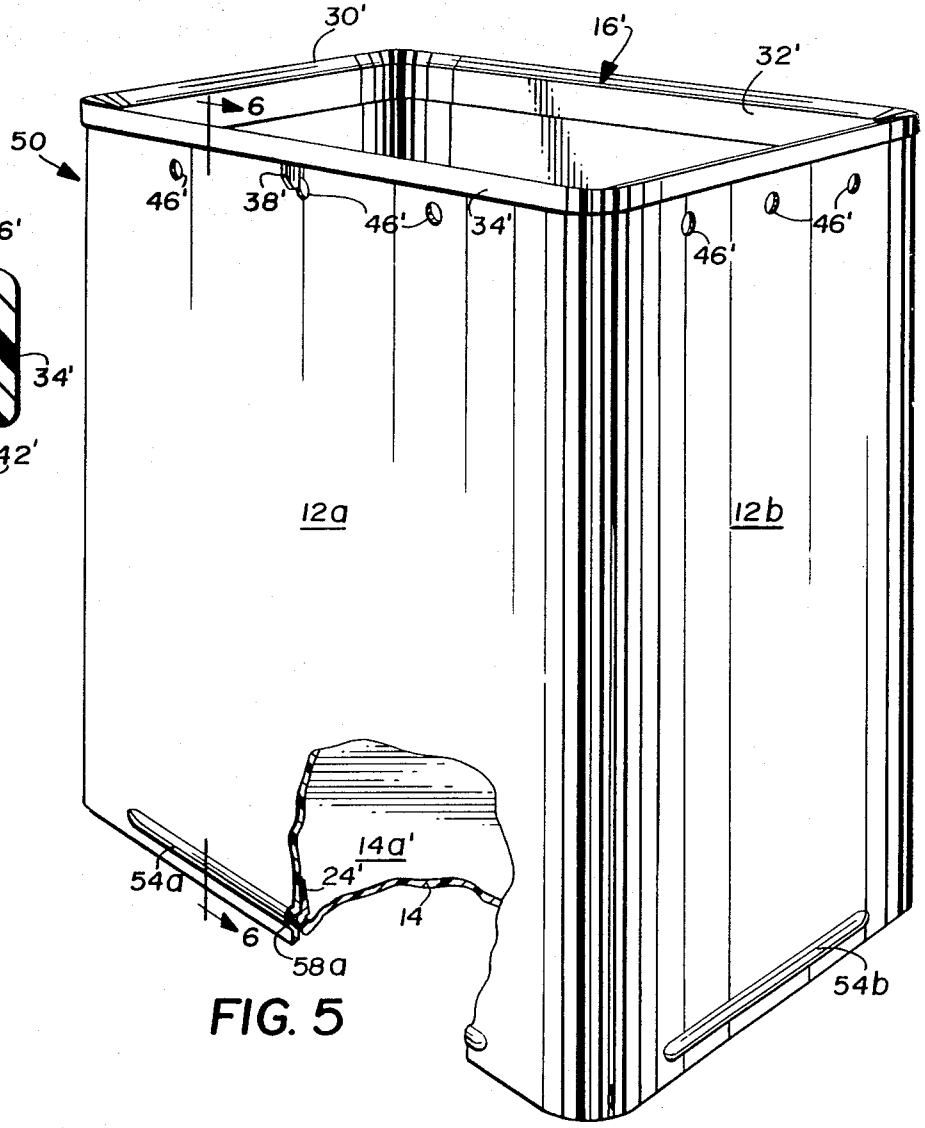
FIG. 5 is an assembled perspective view of another embodiment of a container according to the present invention, and partially broken to show the bottom wall thereof coupled to the side walls.
Figure 6:
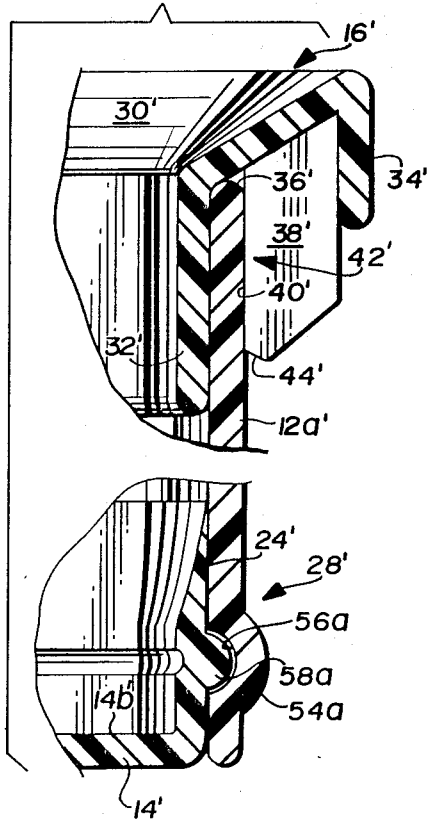
FIG. 6 is a partial cross-sectional view of the container embodiment shown in FIG. 5, and taken along line 6—6 therein.

Another embodiment of a container 50 according to this invention is shown in accompanying FIGS. 5 and 6. The structures of container 50 are very similar to the structures described above with respect to container 10. Thus, the same reference numerals as used to denote the structures of container 10 are employed in FIGS. 5 and 6, except that prime designations (') are also used for the latter FIGURES. A description of these similar structures, having already been discussed above, will not be repeated.

A principal difference between container 10 and container 50 is the means by which the bottom wall 52 of the latter is coupled to the lower region of the region of each side wall 12a'–12d' defines a side walls 12a'–12d'. In this regard, the lower respective integral, substantially horizontal channel members 54a–54d of predetermined length (only members 54a and 54b associated with side walls 12a and 12b, respectively, are visible in FIG. 5, but are representative of members 54c and 54d associated with side walls 12c and 12d, respectively). The channel members 54a–54d define respective interior horizontal grooves 56a–56d (only groove 56a associated with channel member 54a is visible in FIG. 6, but representative of grooves 56b–56d associated with channel members 54b–54d, respectively).

The bottom wall 14' of container 50, like the bottom wall 14 of container 10, includes an upwardly extending seal lip 24'. However, the seal lip 24' includes exteriorly protruding (i.e., relative to the container 50) tongue elements 58a–58d which are mateably received in friction fit relationship within a respective one of the defined grooves 56a–56d. In this regard, although only tongue element 58a is shown in the accompanying drawing FIGS. 5 and 6, it will be appreciated that it is representative of the tongue elements 58b–58d not specifically shown.

When the tongue elements 58a–58d are mated within their respective grooves 56a–56d of channel members 54a–54d, the bottom wall will be coupled to the lower region 28' of the container side walls 12a'–12d' and will thus serve to rigidify the container 50—i.e., will prevent its collapse. Further structural rigidification may be realized by employing the retainer 16' in a similar manner to retainer 16 described above with respect to container 10.

Figure 7D:
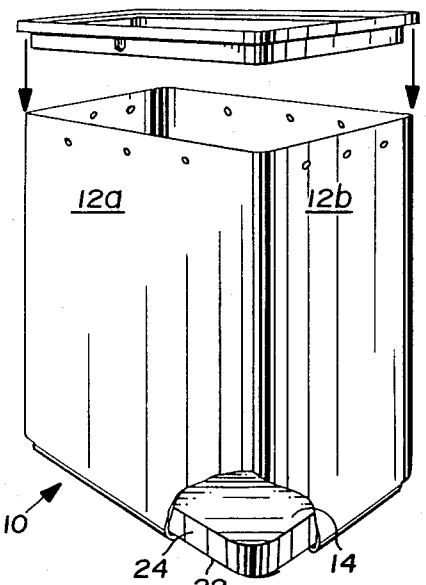
Figure 7C:
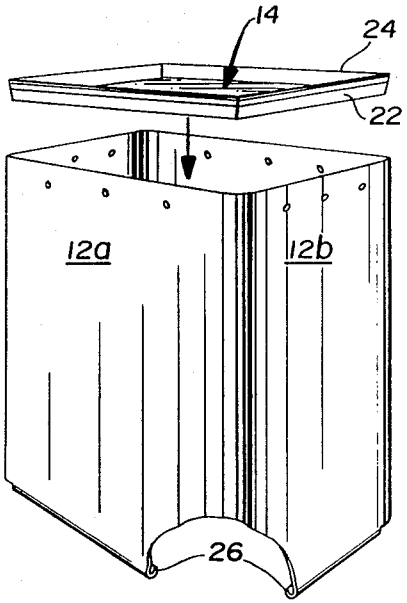
Figure 7B:
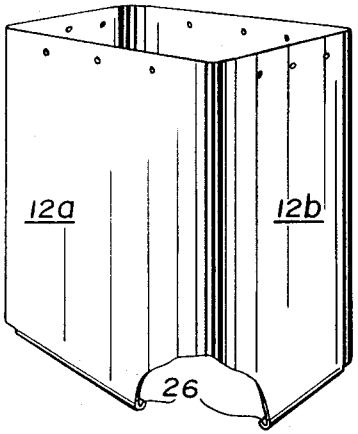
Figure 7A:
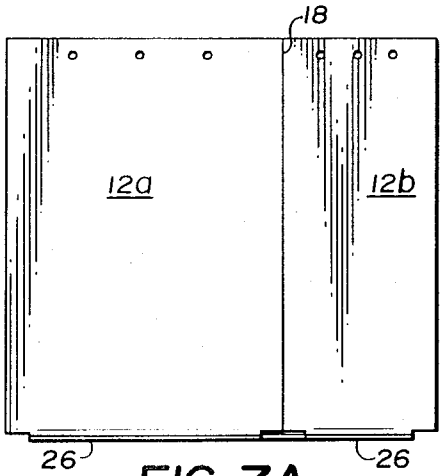

FIGS. 7A–7D show the manner in which the container 10 (and container 50) may be erected. The container 50 during periods of nonuse will be in "kit" form—that is, the bottom wall 14 and the annular retainer 16 (if present) will not be physically coupled to the side walls 12a–12d so that the latter may lie in a collapsed, substantially flat condition. This collapsed condition of the side walls 12a–12d is shown schematically in FIG. 7A. From this collapsed condition, a user may manipulate the side walls 12a–12d (e.g., pivot adjacent ones of the side walls 12a–12d about their respective connecting hinges 18) so as to form an open ended interior space bounded by the same. This condition of the side walls 12a–12d is shown in FIG. 7B.

The bottom wall 14 is then inserted into the defined interior space of the side walls 12a–12d as shown in FIG. 7C until the engagement and receiving flanges 22 and 26, respectively (or the tongue and grooves 58a–58d and 56a–56d, respectively, for container 50), mate with one another. Thereafter, the retainer 16, if employed, may be fitted onto the upper region of the erected container 10 so as to provide additional structural rigidity as is shown in FIG. 7D.

FIGS. 8–11 show another embodiment of a collapsible container 70 according to the present invention. As is seen particularly with reference to FIGS. 8 and 9, the container 70 is generally cylindrical in shape due to the hinges 72 establishing a number of arcuately shaped wall segments 74. The wall segments do not, however, need to be arcuate. That is, the Wall segments could be narrow planar structures With adjacent ones connected along longitudinally edges by means of the hinges 72. In such a case, the container, when erected will approximate a cylinder.

The upper end of the container 70 is closed by means of a lid 76, while the lower end is closed by means of the bottom wall 78. However, as was the case with the embodiments of this invention discussed above, only a rim coupled to the upper end of the container could be provided so that the container has an otherwise open top. The provision of lid 76 so as to close the container's open top is therefore particularly desirable when the container 70 is employed to transport material to prevent its spillage.

The interior lower region 79 of the container 70 is provided with a number of discrete engagement flanges 80. Preferably, each engagement flange 80 is integral with a predetermined one of the side wall segments 74, with adjacent ones of the flanges 80 being radially separated by an intervening side wall segment 74 with which no flange 80 is associated (see FIG. 9). As can be seen more clearly in FIG. 10, the engagement flanges 80 are generally U-shaped in cross-section and thus include a base flange 82 with an upstanding post flange 84. The post flange 84 is thus inwardly spaced in a radial direction from its associated side wall segment 74 and is enlarged at its terminal end 84a.

As with the embodiments of this invention described previously, the bottom wall 78 includes a resilient seal lip 86 extending upwardly from, and continuously about, the peripheral edge region of the bottom Wall 78 so as to define an interior bounded region 88 of the bottom wall 78. The seal lip 86 is preferably unitary with the bottom wall, but could be formed of any suitable flexible material (e.g., elastomeric material) and joined to the peripheral region of the bottom wall (e.g., as by means of a suitable adhesive).

The seal lip 86 is tapered from the bounded region 88 of the bottom wall 78 towards its terminal edge 86a. The seal lip 86, moreover, is outwardly flared relative to the bounded interior region 88 of bottom wall 78 so that when the bottom wall 78 is coupled to the side wall segments 74 (via the engagement flanges 80 as will be discussed in greater detail below), the seal lip 86 will be flexed inwardly relative to the bounded region 88. This inward flexion against the seal lip's tendency to be outwardly flared thus urges the same into positive sealing engagement with the side wall segments 74.

A pair of radially spaced apart finger members 90, 92 depend from the bottom wall 78 at its peripheral edge region. As is seen in FIG. 10, finger member 90 is enlarged at its terminal end 90a so that it will conform in an annular interlocking relationship to the enlarged region 84a of post flange 84. In addition, when the bottom wall 78 is pressed downwardly during erection of the container 70, the enlarged region 84a of post flange 84 will engage the enlarged region 90a of finger member 90 thereby responsively causing a beneficial camming action to allow the post flange 84 to more easily enter the space defined between the finger members 90, 92. In such a manner, post flange 84 is removably captured between the finger members 90 and 92, and hence, the bottom wall 78 is removably coupled to the side wall segments 74.

The paired finger members 90, 92 are preferably annularly continuous so that the post flanges 84 are positively engaged regardless of the radial orientation of the bottom wall 78. However, the finger members 90, 92 could also be embodied in number of discrete, radially separated elements which then register with corresponding ones of the post flanges 84 when the bottom wall is inserted into the erected side wall segments 74.

The bottom wall 78, when removably coupled to the side wall segments 74, will serve to rigidify the latter (i.e., will prevent the side wall segments 74 from collapsing to a substantially flat configuration). Additional rigidification can be provided by means of a rim of the type previously described above in connection with FIGS. 1–6. In the embodiment shown in FIGS. 8–11, however, this additional rigidification is accomplished by means of a lid 76 which closes the upper end of the erected container 70. Preferably the lid 76 is a one-piece construction which includes a lid wall 94 and an annular rim portion 96.

As is seen in FIGS. 10 and 11, the upper region of the container 70 is provided with a number of engagement lips 98 integrally associated with at least a meaningful number of the side wall segments 74 sufficient to provide positive coupling between the rim 96 and the top of the container 70. Preferably, each such side wall segment 74 includes one of the engagement lips 98.

The engagement lips 98 define a convex surface which mates with a concave surface of a respective one of the clip members 100 dependently provided in the interior annular space 102 of the rim portion 94. Only one such clip member 100 is shown in accompanying FIGS. 10 and 11, but is representative of the other clip members 100 radially spaced apart in the annular space 102 of rim portion 94. When each wall segment 74 includes one of the engagement lips 98, it is preferred that a corresponding number of clip members 100 be provided in the annular space 102 of rim 96 at locations which register with the engagement lips 98.

The circumferential width dimension of the individual clips 100 is preferably chosen so that it may pass between adjacent ones of the engagement lips 98. In such a manner, the lid 76 may also be removably coupled by aligning the clips 100 with respective spaces between engagement lips 98, pressing the lid 76 onto the upper edges of the side wall segments 74, and thereafter turning the lid 76 until the convex and concave surfaces of the engagement lips 98 and clips 100, respectively, mate one to the other.

However, the clip 100 could be in the form of a continuous annular structure in which case it may simply be "press-fit" onto the upper edges of the container segments 74 so as to couple the lid 76 to the top of the container 70. That is, when the lid 76 is pressed onto the upper edges of the side wall segments 74, the clip 100 will be caused to engage all of the engagement lips 98 thereby releasably coupling the lid 76 to the erected container 70 to provide further rigidification thereto.

Alternative means to seal the bottom and side walls of the containers according to this invention are shown in accompanying FIGS. 12 and 13. The sealing embodiment shown in FIG. 12 is generally similar to FIG. 3 already discussed above, with the principal exception being that an annular sealing bead 110 is co-formed at the terminal end of seal lip 24. An annular interior concavity 112 formed in the lower side wall 28 thereby receives the bead 110 so as to provide an effective seal between the bottom wall peripheral edge **14*a* and the side wall lower portion 28**.

A simplified sealing structure is shown in FIG. 13 whereby the peripheral edge 120 of bottom wall 122 includes a co-formed annularly peripheral bead 124. The bead 124 is, like bead 110 discussed immediately above, received in an annular interior concavity 126 in side wall portion 128 so as to seal the peripheral edge 120 and the side wall portion 128 thereat.

The beads 110 and/or 124 may be co-formed with the bottom wall peripheral edges by any technique well known to those in the plastics fabrication art. Preferably the beads 110 and/or 124 will be coinjected with the bottom wall and will be of a different material (preferably a softer, more pliable—e.g., elastomeric—material) as compared to that of the bottom wall. Alternatively, the beads 110 and/or 124 may be separately formed and then attached to the peripheral edge of the bottom wall via any suitable adhesive compound.

The material from which the side walls are constructed is not critical to the present invention. Preferably, the various structures of the present invention, including the side walls will be formed of a durable plastic. Metal (e.g., aluminum) may also be employed with suitable hinges to permit the side walls to be collapsed. The plastic material or metal may also be of the expanded type so as to further reduce the weight of the container, in which case a flexible liner will need to be employed if the container is used to store and/or transport granular or liquid materials. Suffice it to say here, that the selection of any particular material for any particular component of the present invention will depend upon a number of factors, including the ease and costs of production, and the intended end use application for the container, to name just a few.

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A collapsible container comprising:

plural side walls;

hinge means joining adjacent side walls so as to allow said side walls to be moved between (a) a collapsed condition in which said side walls lie substantially flat, and (b) an erected condition in which said side walls define, in cross-section, an interior area for receiving articles therewithin;

a bottom wall which establishes a peripheral edge region sized and configured so as to closely match said interior area of said erected side walls; and means for removably coupling said bottom wall to lower regions of said side walls when in said erected condition, whereby said side walls are maintained in said erected condition, wherein said bottom wall includes seal means extending upwardly from said peripheral edge region and providing sealing contact with said side walls when said bottom wall is removably coupled to said lower regions thereof.

2. A collapsible container as in claim 1, wherein said coupling means includes at least one engagement flange extending downwardly from said peripheral edge region of said bottom wall, and at least one generally U-shaped flange associated with a respective one of said side walls, said U-shaped flange defining a space with said respective side wall for capturing said engagement flange of said bottom wall.

3. A collapsible container as in claim 2, wherein said engagement flange and said U-shaped flange each include enlarged regions at their respective terminal ends, said enlarged regions annularly interlocking with one another so as to removably couple said bottom wall to said side walls.

4. A collapsible container as in claim 1, wherein said coupling means includes cooperating tongue and groove means having plural tongues associated with one of said bottom wall and side walls, and grooves defined on the other of said bottom wall and side walls.

5. A collapsible container as in claim 1, wherein said seal means includes a tapered sealing lip extending continuously around said bottom wall peripheral region.

6. A collapsible container as in claim 5, wherein said seal means includes integral means for urging said seal means into sealing engagement with said side walls.

7. A collapsible container as in claim 6, wherein said means for urging is provided, at least in part, by means of said seal lip being outwardly flared relative to said bottom wall.

8. A collapsible container as in claim 5, wherein said seal lip includes an annular bead formed at a terminal end of said seal lip.

9. A collapsible container as in claim 8, wherein said side wall includes means defining an annular interior concavity, said annular bead being seated in said defined concavity when said bottom wall is coupled to said side wall lower region thereby sealing said bottom and side walls thereat.

10. A collapsible container as in claim 9, wherein said seal lip and said annular bead are formed of different plastics material.

11. A collapsible container as in claim 1, wherein said seal means includes an annular bead formed on a peripheral edge of said bottom wall, and means defining an annular interior concavity, said annular bead being seated in said defined concavity when said bottom wall is coupled to said side wall lower region thereby sealing said bottom and side walls thereat.

12. A collapsible container as in claim 11, wherein said bottom wall and said annular bead are formed of different plastics material.

13. A collapsible container as in claim 1, further comprising annular ring means removably coupled to an upper edge of said side walls for assisting in maintaining said side walls in said erected condition.

14. A collapsible container as in claim 13, wherein said annular ring means includes gripping means for frictionally gripping at least a preselected one of said side walls and thereby be removably coupled to said side wall upper edge.

15. A collapsible container as in claim 14, wherein said annular ring means is generally U-shaped in cross-section.

16. A collapsible container as in claim 14, wherein said gripping means includes a downwardly projecting finger member defining a slot into which a portion of said upper edge region of said at least one side wall is accepted, said finger member frictionally engaging said portion of said upper edge region when accepted within said defined slot.

17. A collapsible container as in claim 1, further comprising a lid, and means for removably connecting said lid to an upper edge of said container.

18. A collapsible container as in claim 17, wherein said lid includes a lid wall, and a rim annularly connected to said lid wall.

19. A collapsible container as in claim 18, wherein said rim defines an interior annular space, and wherein said means for removably connecting said lid to said upper container edge includes;

a number of engagement lips associated with preselected ones of said side walls, and clip members disposed within said annular space of said rim and cooperating with said engagement lips so as to removably couple said lid to said upper edge of said container.

20. A collapsible container as in claim 19, wherein adjacent pairs of said hinge means establish relatively narrow side walls of a dimension and number such that said container at least closely approximates a cylinder when said plural side walls are erected.

21. A container comprising:

first and second pairs of side walls;

hinge means for connecting lateral edges of said side walls of said first pair to respective lateral edges of each of said side walls of said second pair to allow said side walls to be folded into (i) a collapsed condition whereby a side wall of said first pair lies closely adjacent a respective side wall of said second pair so that said side walls are oriented in a generally flat configuration, and (ii) an erected condition whereby said first and second pairs of side walls collectively establish an open area of predetermined cross-sectional geometry to receive articles;

a bottom wall having a peripheral edge region sized and configured so as to closely match said cross-sectional geometry of said side walls when in said erected condition;

means for removably coupling said bottom wall to lower regions of said first and second side walls;

said bottom wall providing means for maintaining said first and second side walls in said erected condition when the same is removably coupled to said bottom wall regions of said first and second side walls;

said bottom wall including a flexible seal lip extending upwardly therefrom and continuously around said peripheral edge region, said seal lip being outwardly flared relative to said peripheral region of said bottom wall, said seal lip being inwardly flexed against its tendency to be outwardly flared by means of its contact with said first and second side walls when said bottom wall is removably coupled to said lower regions thereof, whereby said seal lip is urged into sealing contact with said first and second side wall pairs.

22. A collapsible container as in claim 21, wherein said coupling means includes at least one engagement flange extending downwardly from said peripheral edge region of said bottom wall, and at least one generally U-shaped flange associated with a respective one of said side walls, said U-shaped flange defining a space with said respective side wall for capturing said engagement flange of said bottom wall.

23. A collapsible container as in claim 21, wherein said coupling means includes cooperating tongue and groove means having plural tongues associated with one of said bottom wall and side walls, and grooves defined on the other of said bottom wall and side walls.

24. A collapsible container as in claim 21, wherein said seal lip is tapered.

25. A collapsible container as in claim 21, further comprising annular ring means removably coupled to an upper edge of said side walls for assisting in maintaining said side walls in said erected condition.

26. A collapsible container as in claim 25, wherein said annular ring means includes gripping means for frictionally gripping at least a preselected one of said side walls and thereby be removably coupled to said side wall upper edge.

27. A collapsible container as in claim 26, wherein said annular ring means is generally U-shaped in cross-section.

28. A collapsible container as in claim 26, wherein said gripping means includes a downwardly projecting finger member defining a slot into which a portion of said upper edge region of said at least one side wall is accepted, said finger member frictionally engaging said portion of said upper edge region when accepted within said defined slot.

29. A kit from which a container may be erected comprising:

plural side walls in a collapsed condition such that said side walls are in a substantially flat configuration;

said side walls including hinge means for joining adjacent ones of said side walls to allow said side walls to be moved into an erected condition wherein said side walls collectively define an interior area of preselected cross-sectional geometry;

a bottom wall having a peripheral edge region sized so as to closely match said cross-sectional geometry of said interior area, and adapted to being removably coupled to lower regions of said side walls when said side walls are in said erected condition, said bottom wall including a flexible seal lip extending upwardly therefrom and continuously around said peripheral edge region, said seal lip being outwardly flared relative to said peripheral region of said bottom wall, said seal lip being inwardly flexed against its tendency to be outwardly flared by means of its contact with said side walls when said bottom wall is removably coupled to said lower regions thereof, whereby said seal lip is urged into sealing contact with said plural side walls.

30. A kit as in claim 29, further comprising annular ring means removably coupled to a upper edge of said side walls for assisting in maintaining said side walls in said erected condition.

31. A kit as in claim 30, wherein said annular ring means includes gripping means for frictionally gripping at least a preselected one of said side walls and thereby be removably coupled to said side wall upper edge.

32. A kit as in claim 31, wherein said annular ring means is generally U-shaped in cross-section.

33. A kit as in claim 31, wherein said gripping means includes a downwardly projecting finger member defining a slot into which a portion of said upper edge region of said at least one side wall is accepted, said finger member frictionally engaging said portion of said upper edge region when accepted within said defined slot.

34. A kit as in claim 29, further comprising a lid, and means for removably connecting said lid to an upper edge of said container.

35. A kit as in claim 34, wherein said lid includes a lid wall, and a rim annularly connected to said lid wall.

36. A kit as in claim 35, wherein said rim defines an interior annular space, and wherein said means for removably connecting said lid to said upper container edge includes;

a number of engagement lips associated with preselected ones of said side walls, and clip members disposed within said annular space of said rim and cooperating with said engagement lips so as to removably couple said lid to said upper edge of said container.

37. A kit as in claim 29, wherein adjacent pairs of said hinge means establish relatively narrow side walls of a dimension and number such that said container at least closely approximates a cylinder when said plural side walls are erected.

* * * * *